US005538351A

United States Patent [19]

Miyano

[11] Patent Number: 5,538,351

[45] Date of Patent: Jul. 23, 1996

[54] THERMAL TRANSFER PRINTER AND RIBBON CHANGE STRUCTURE

[75] Inventor: Tsuyoshi Miyano, Iwate-Ken, Japan

[73] Assignee: Alps Electric Co., Ltd., Tokyo, Japan

[21] Appl. No.: 551,212

[22] Filed: Oct. 31, 1995

[30] Foreign Application Priority Data

Nov. 9, 1994 [JP] Japan ..... 6-275148

[51] Int. Cl.[6] ..... B41J 35/22

[52] U.S. Cl. ..... 400/206; 400/692; 400/249

[58] Field of Search ..... 400/206, 206.2, 400/692, 249, 250

[56] References Cited

U.S. PATENT DOCUMENTS 4,622,563 11/1986 Watanabe ..... 400/206

4,694,305 9/1987 Shiomi et al. ..... 400/206

5,370,469 12/1994 Mutou et al. ..... 400/206

*Primary Examiner*—John S. Hilten

*Attorney, Agent, or Firm*—Guy W. Shoup; Patrick T. Bever

[57] ABSTRACT

A thermal transfer printer capable of elongating the period in which the ink ribbon can be used so that the frequency of ribbon cassette changes is reduced, the thermal transfer printer including a control unit arranged such that, if an end of an ink ribbon in the ribbon cassette mounted on a carriage is detected in a case where ribbon cassettes accommodating the same color ink ribbons are held in a plurality of cassette holding portions, the control unit causes the consumed ribbon cassette to be sent to an empty cassette holding portion and a new ribbon cassette to be selected and mounted on the carriage.

2 Claims, 7 Drawing Sheets

THERMAL TRANSFER PRINTER AND RIBBON CHANGE STRUCTURE

BACKGROUND OF THE INVENTION

1. Field of the Invention

The present invention relates to a thermal transfer printer, and more particularly to a thermal transfer printer of a type reserving ribbon cassettes at a plurality of predetermined positions to select a required ribbon cassette from the plural ribbon cassettes to mount the selected ribbon cassette on a carriage so as to record data by using the selected ribbon cassette.

2. Description of the Prior Art

In recent years, there arises a desire for color printing, and a thermal transfer printer capable of forming a color image has been desired. An ink ribbon 80 for use in a general color thermal transfer printer has a structure such that three color ink portions consisting of yellow (Y), magenta (M) and cyan (C) color ink portions or four color ink portions consisting of the foregoing three color ink portions and a black (B) color portion are repeatedly formed in a lengthwise direction of the ink ribbon 80 in such a manner that each color ink portion is longer than a width to be printed. In accordance with data to be recorded, each color ink portion is selected to perform recording.

In a thermal transfer printer of a type using an ink ribbon of the foregoing type, a color portion, which is not used in the present recording operation, is skipped and a next color ink portion is selected to perform recording. If a portion, which is not recorded, exists in the same line, the ink ribbon is inevitably moved. Therefore, portions, which are not used in the recording operation, are wasted, thereby enlarging the running cost. Moreover, the amount of ribbon cassettes to be used is enlarged, thus causing an environmental problem to arise in that garbage of used cassette increases.

To overcome the foregoing problems, the applicant of the present invention has disclosed a thermal transfer printer for performing a color recording operation by changing ribbon cassettes in such a manner that ribbon cassettes each accommodating a monotone ink ribbon are held in a plurality of portions, a ribbon cassette accommodating an ink ribbon for the color for use in the recording operation is selected, and the selected ribbon cassette is mounted on a carriage to perform recording (refer to, for example, Japanese Patent Laid-Open No. 2103173 and Japanese Patent Laid-Open No. 2-103174).

Since only a portion of the ink ribbon, which is used in the recording operation, is fed in the thermal transfer printer for color recording of a type changing the ribbon cassette, the ink ribbon can substantially fully be used in the recording operation. Thus, the running cost and the amount of ribbon cassettes to be disposed can be reduced as compared with the foregoing thermal transfer printer of the type using the repetitive type ink ribbon.

With a thermal transfer printers of the type changing the ribbon cassette disclosed in Japanese Patent Laid-Open No. 2-103173 or Japanese Patent Laid-Open No. 2-103174, ink ribbons to be mounted on the corresponding cassette holding portions are previously determined. Thus, if a ribbon cassette accommodating a different color ink ribbon is mounted, a desired result cannot be realized in printing. Moreover, in a case where color printing is not required, lowering of the frequency of change of the ribbon cassette in such a manner that a plurality of the same color ribbon cassettes are prepared cannot be lowered.

SUMMARY OF THE INVENTION

Accordingly, an object of the present invention is to provide a thermal transfer printer, which is capable of overcoming the problems experienced with the conventional thermal transfer printers and enabling the period in which the ink ribbon can be used to be elongated so that the frequency of ribbon cassette changes is reduced, which can be used easily and simply and with which a satisfactory quality can be realized in printing.

An object of the present invention is to provide a thermal transfer printer comprising a carriage capable of reciprocating along a platen; a cassette mounting frame which is disposed on the carriage and on which a ribbon cassette can be mounted; a plurality of cassette holding portions formed at positions at which the plurality of cassette holding portions face the cassette mounting frame and each of which is capable of holding the ribbon cassette; cassette detection means disposed on the carriage and capable of detecting the type of the ribbon cassette held in the cassette holding portion when the carriage is moved; ribbon-end detection means disposed on the carriage and capable of detecting the end of the ink ribbon accommodated in the ribbon cassette mounted on the carriage; and drive means for reciprocating the cassette mounting frame and the cassette holding portion in directions in which the cassette mounting frame and the cassette holding portion mutually contact and separate from each other, wherein the drive means causes the cassette mounting frame and the cassette holding portion to contact and separate from each other to enable the ribbon cassette to be supplied/received between the cassette mounting frame and the cassette holding portion, and the thermal transfer printer further comprises control means arranged such that, when the ribbon-end detection means has detected the end of the ink ribbon in the ribbon cassette mounted on the carriage in a case where ribbon cassettes accommodating the same color ink ribbons are held in at least two cassette holding portions, the control means causes the consumed ribbon cassette to be sent to an empty cassette holding portion, the cassette detection means to detect a ribbon cassette accommodating another same color ink ribbon, and the detected ribbon cassette to be received from the cassette holding portion and to be mounted on the cassette mounting frame.

Another object of the present invention is to provide a thermal transfer printer comprising a carriage capable of reciprocating along a platen; a cassette mounting frame which is disposed on the carriage and on which a ribbon cassette can be mounted; a plurality of cassette holding portions formed at positions at which the plurality of cassette holding portions face the cassette mounting frame and each of which is capable of holding the ribbon cassette; cassette detection means disposed on the carriage and capable of detecting the type of the ribbon cassette held in the cassette holding portion when the carriage is moved; ribbon-end detection means disposed on the carriage and capable of detecting the end of the ink ribbon accommodated in the ribbon cassette mounted on the carriage; and drive means for reciprocating the cassette mounting frame and the cassette holding portion in directions in which the cassette mounting frame and the cassette holding portion mutually contact and separate from each other, wherein the drive means causes the cassette mounting frame and the cassette holding portion to contact and separate from each other to enable the ribbon cassette to be supplied/received between the cassette mounting frame and the cassette holding portion, and the thermal transfer printer further comprises storage means, arranged such that, in a case where ribbon cassettes accommodating the same color ink ribbons are held in at least two cassette holding portions, the storage means stores the positions of the cassette holding portions and the type of the ribbon cassettes; means arranged such that, when the ribbon-end detection means has detected the end of the ink ribbon in the ribbon cassette mounted on the carriage, the means detects whether or not a ribbon cassette of the same type as the consumed ribbon cassette is held in the cassette holding portion, and control means arranged such that, if the same type ribbon cassette is held, the control means causes the consumed ribbon cassette to be sent to an empty cassette holding portion, the cassette detection means to detect a ribbon cassette accommodating another same color ink ribbon, and the detected ribbon cassette to be received from the cassette holding portion and to be mounted on the cassette mounting frame.

The thermal transfer printer according to the present invention has the structure such that ribbon cassettes accommodating the same-color ink ribbons are mounted on a plurality of cassette holding portions, and change to a new ribbon cassette is performed whenever the ink ribbon in one ribbon cassette is consumed so that the period in which the ribbon cassette can be used is elongated.

Other and further objects, features and advantage of the invention will be appear more fully from the following description.

DETAILED DESCRIPTION OF THE PREFERRED EMBODIMENTS

A preferred embodiment of a thermal transfer printer according to the present invention will now be described with reference to the drawings.

Figure 1:
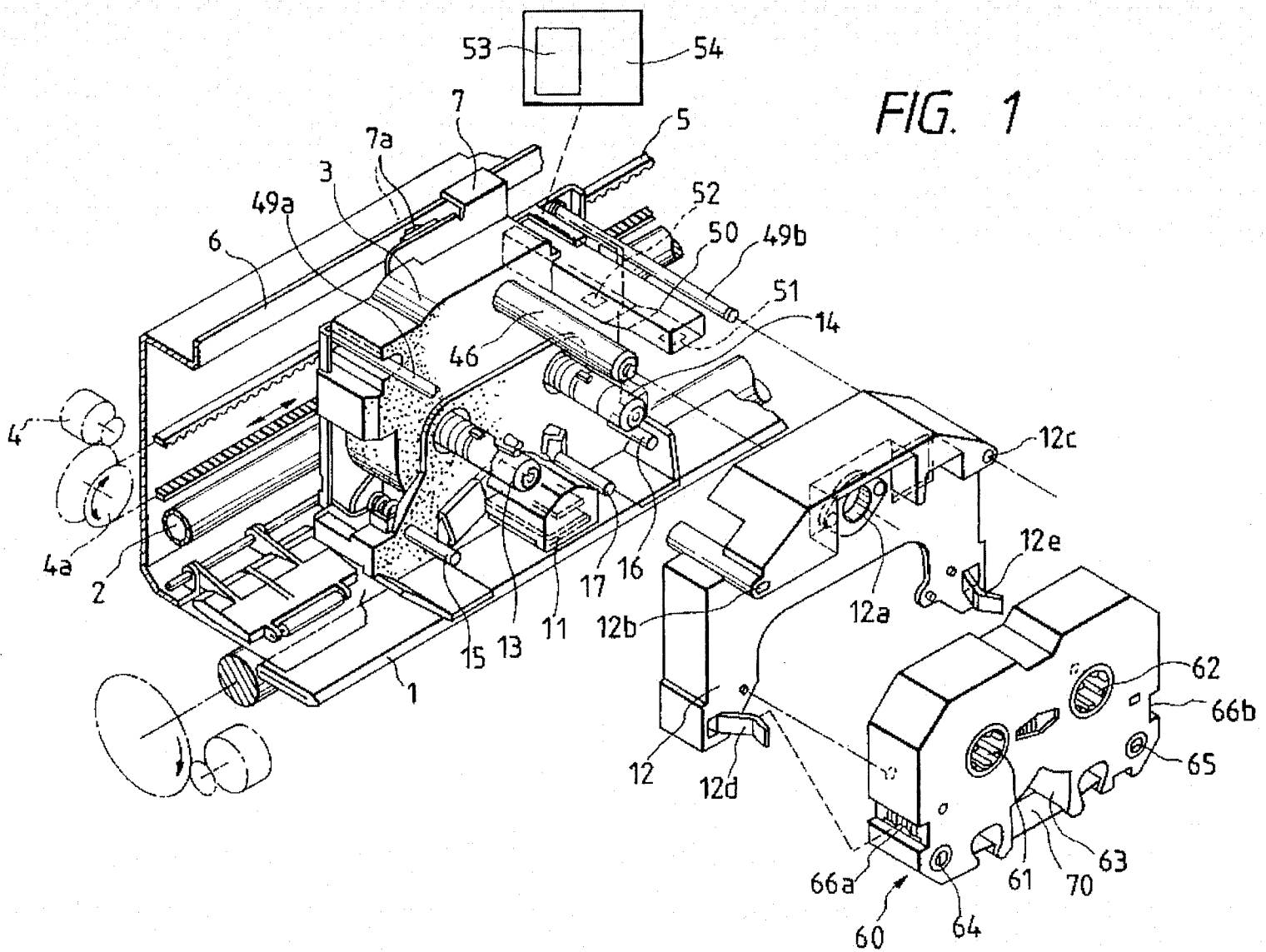
FIG. 1 is a schematic view showing an essential portion of an embodiment of a thermal transfer printer according to the present invention.
Figure 2:
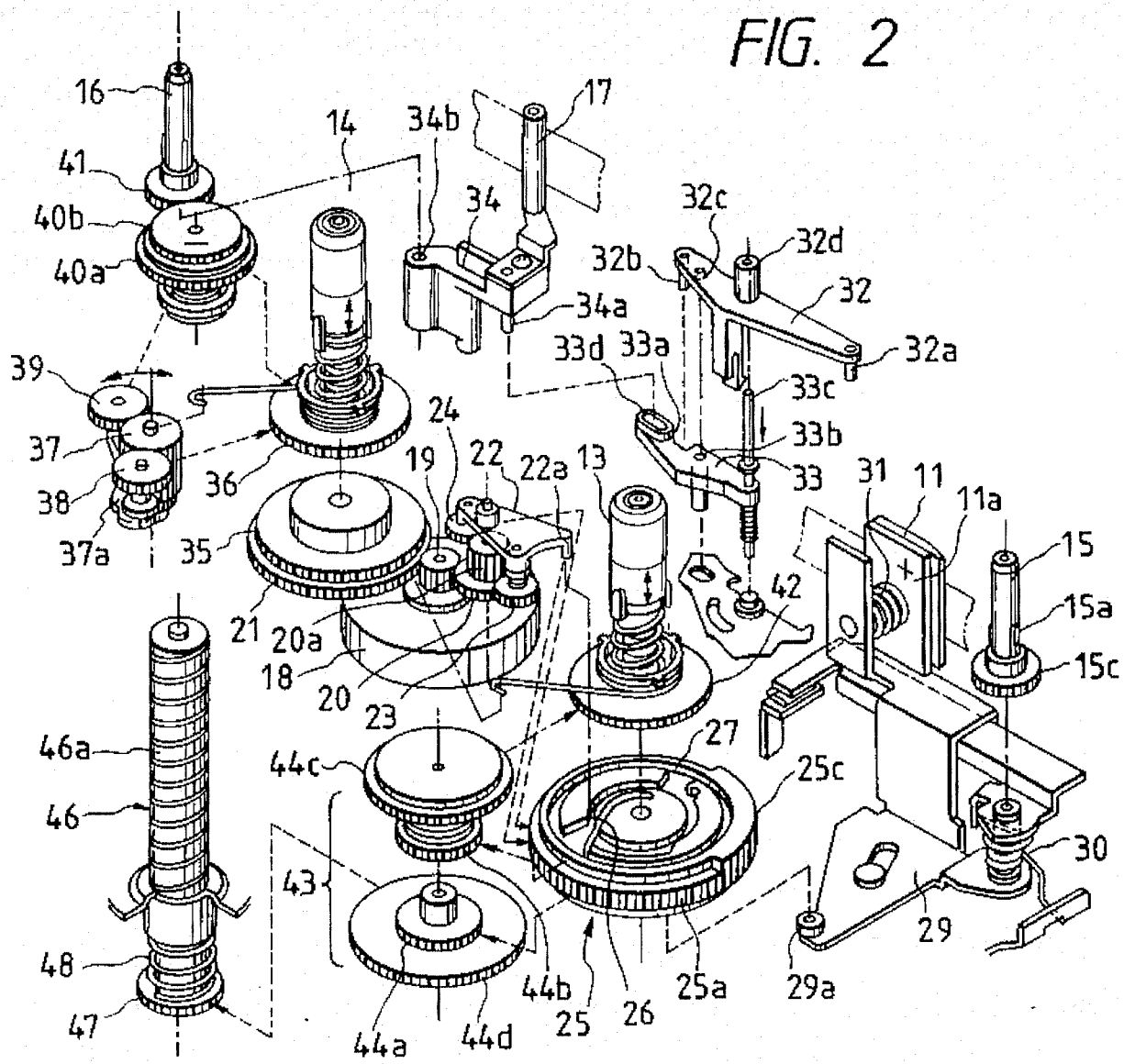
FIG. 2 is an exploded perspective view showing the structure of an essential portion of the embodiment of the thermal transfer printer according to the present invention.
Figure 3:
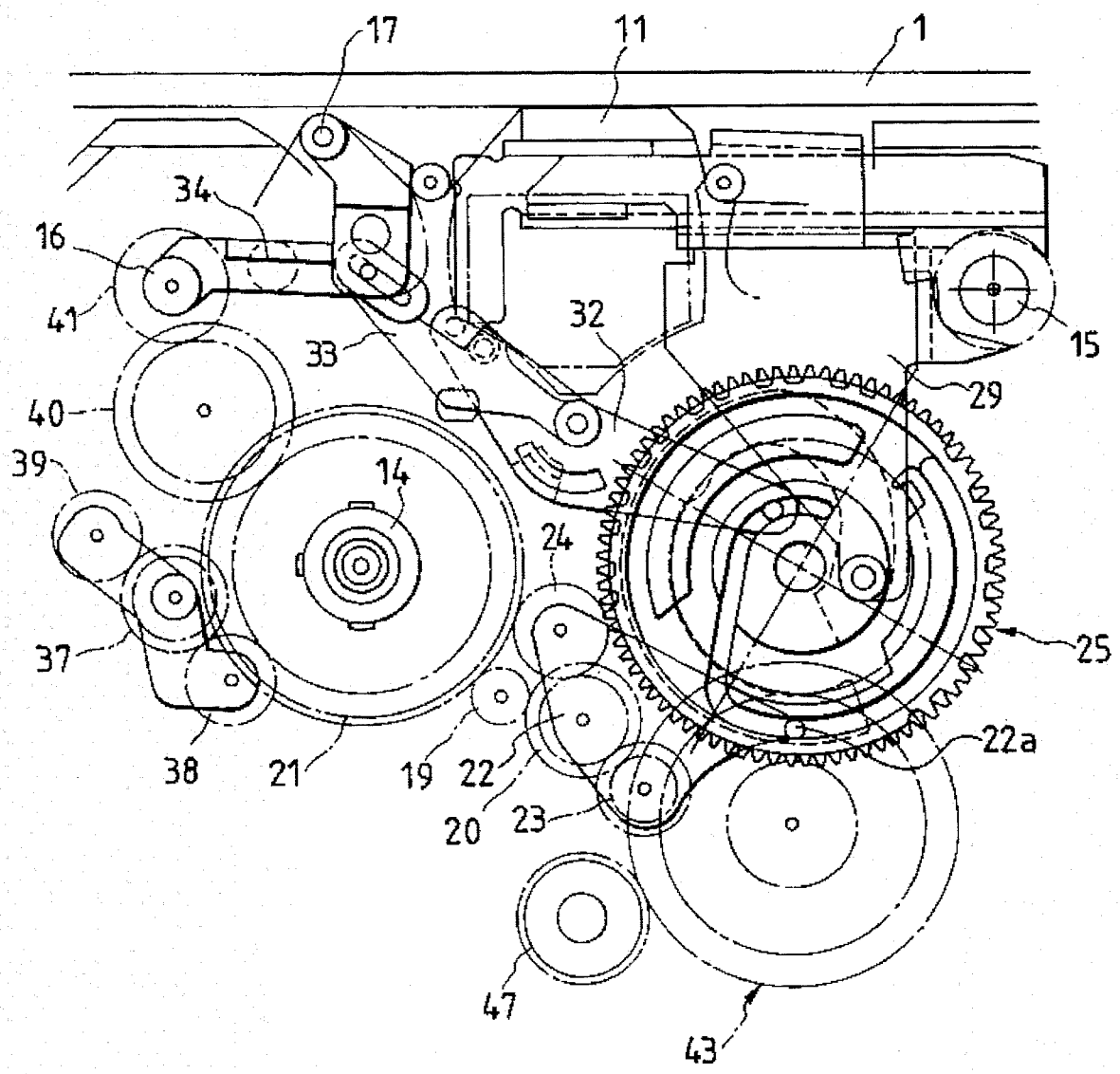
FIG. 3 is a schematic view showing an essential portion of the embodiment of the thermal transfer printer according to the present invention in a head down state.

FIGS. 1 to 3 are schematic views showing the structure of an embodiment of the thermal transfer printer according to the present invention.

As shown in FIG. 1, the thermal transfer printer according to the present invention includes a plate-like platen 1 which receives a load when a thermal head 11, to be described later, presses against a sheet and an ink ribbon 70. A carriage guide shaft 2 extending in parallel to the platen 1 is arranged between two side plates (not shown) of the case of the thermal transfer printer. A carriage 3 serving as an essential portion for the recording operation is slidably held by the guide shaft 2. The case of the thermal transfer printer has a plate-like carriage guide portion 6 for guiding the carriage 3 when it is moved, the carriage guide portion 6 being extended to run parallel to the platen 1. A carriage support portion 7 is projected over the rear portion of the carriage 3, the carriage support portion 7 being slidably held by the carriage guide portion 6.

A carriage drive motor 4 is disposed in the lower portion in the rear of the carriage guide portion 6. A sprocket 4*a*, which is rotated by the carriage drive motor 4, is disposed adjacent to the carriage drive motor 4. A toothed drive belt 5, having an end secured to the carriage 3, is wound around the sprocket 4*a*. When the carriage drive motor 4 is rotated, the toothed drive belt 5 is operated to reciprocate the carriage 3 in parallel to the platen 1 along the guide shaft 2 and the carriage guide portion 6. The carriage support portion 7, which slides along the carriage guide portion 6 and which guides the carriage 3, has a cross sectional shape in the form of a substantially U-shape facing sidewards. Projections 7*a* being in contact with the carriage guide portion 6 are formed on the two inner opposing surfaces of the U-shape portion of the carriage support portion 7. The projections 7*a* protect the carriage 3 from being rattled during its movement.

Elements in the carriage 3 will now be described. A thermal head 11 has a plurality of heating devices (not shown) disposed therein, the thermal head 11 being made moveable to contact/release with respect to the platen 1. A cassette carrier 12 is made moveable perpendicular to a direction, in which the carriage 3 is moved during the recording operation, the cassette carrier 12 being capable of carrying a ribbon cassette 60 mounted thereon. A supply bobbin 13 and a winding bobbin 14 are respectively engaged to a supply reel 61 and a winding reel 62 around which an ink ribbon 70 accommodated in the ribbon cassette 60 is, at the two ends thereof, wound. The ribbon cassette 60 in the form of the U-shape has the front portion which faces an intermediate portion of the ink ribbon 70 ejected from the ribbon cassette 60. A pair of pinch rollers 64 and 65 are disposed upstream and downstream in the direction, in which the ink ribbon 70 moves, the pinch rollers 64 and 65 being disposed in such a manner that a thermal head insertion portion 63 of the ribbon cassette 60 is disposed between the pinch rollers 64 and 65. A second supply bobbin 15 and a second winding bobbin 16 are respectively engaged to the pair of pinch rollers 64 and 65. A separation roller 17 is disposed downstream from the thermal head 11 in the direction, in which the ink ribbon 70 is moved, the separation roller 17 being selectively rotated in accordance with the type of the ribbon cassette 60. Furthermore, drive members, to be described later, are disposed to drive the foregoing elements.

As will be described later, the operations of the thermal head 11 to press the platen 1 and to separate from the same, the operation of the cassette carrier 12 to move in the directions in which the cassette carrier 12 contacts/release with respect to the carriage 3, the operation for supplying, winding and rewinding the ink ribbon 70, and the operation for rotating the separation roller 17 are performed by one stepping motor 18 (see FIG. 2) disposed on the carriage 3, as described later. Note that the operation of the thermal head 11 to press the platen 1 is called a head down operation and the operation of the thermal head 11 to separate from the platen 1 is called a head up operation.

The stepping motor 18 has an output pinion gear 19 to which a first transmission gear 20 and a second transmission gear 21 are engaged. The first transmission gear 20 has an upper surface to which a substantially triangular swinging plate 22 is attached, the swinging plate 22 being capable of rotated relative to a rotational center 20*a* of the transmission gear 20.

The swinging plate 22 has an end at which a pin 22*a* is disposed, the pin 22*a* being engaged to a cam groove 26 formed on the top surface of a cam 25. The swinging plate 22 has other two ends at which a first swinging gear 23 and a second swinging gear 24, which are engaged to the transmission gear 20, are disposed. In accordance with the position at which the swinging plate 22 is located due to the swinging operation, either of the two swinging gears 23 and 24 is engaged to a gear portion 25*a* having a tooth-less portion 25*b*, the gear portion 25*a* being formed in substantially the central portion of a cam 25 in the widthwise direction of the outer surface of the cam 25, the cam 25 being disposed adjacent to the swinging plate 22. The swinging plate 22 has an upper surface to which a leading portion of a spring (not shown) is connected. The elastic force of the spring always urges the swinging plate 22 in the direction toward the cam 25.

Figure 4:
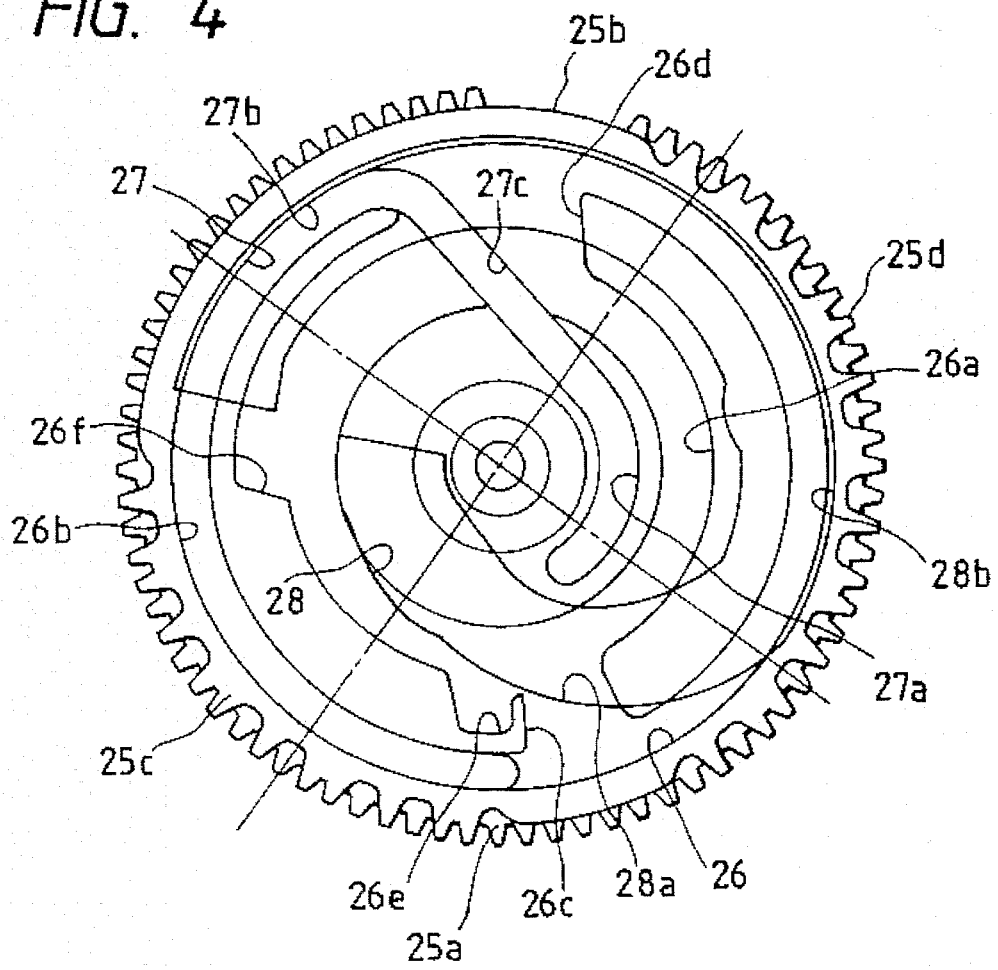
FIG. 4 is a schematic view showing the structure of a cam of the thermal transfer printer according to the embodiment of the present invention.

As shown in FIG. 4, the cam 25 has, on the outer surface thereof, the gear portion 25*a* formed around the central portion in terms of the direction of the thickness of the cam 25, the gear portion 25*a* having the tooth-less portion 25*b* formed in a portion in the circumferential direction of the gear portion 25*a*; a first intermittent gear 25*c* formed in substantially an upper quarter portion of the circumference in terms of the direction of the thickness of the cam 25; a second intermittent gear 25*d* shifted from the first intermittent gear 25*c* in the circumferential direction of the cam 25 and formed in substantially lower ⅖ portion of the circumference in the direction of the thickness of the cam 25. The shapes of the teeth of the two intermittent gears 25*c* and 25*d* are, as shown in FIG. 4, formed such that two adjacent teeth and one tooth are alternately formed at intervals each of which corresponds to one tooth.

The cam 25 has an upper surface in which a first cam groove 26, to which the pin 22*a* of the swinging plate 22 is engaged, and a second cam groove 27 for contacting/releasing the separation roller 17 are formed. The cam 25 has a lower surface in which a cam groove 28 for contacting/releasing the thermal head 11 is formed.

The first cam groove 26 is formed by communicating an inner annular groove 26*a* and an outer annular groove 26*b* formed eccentrically with each other by two communication grooves 26*c* and 26*d* formed in substantially the direction of the diameter. As shown in FIG. 1, when the first swinging gear 23 is engaged to the gear portion 25*a*, the pin 22*a* is received by the inner groove 26*a*. When the second swinging gear 24 is engaged to the gear portion 25*a*, the pin 22*a* is received by the outer groove 26*b*. The first cam groove 26 has fastening portions 26*e* and 27*f* for fastening the pin 22*a* within the inner groove 26*a* in order to maintain the swinging gears 23 and 24 at positions at which the swinging gears 23 and 24 do not engage to the gear portion 25*a*.

The second cam groove 27 for contacting/releasing the separation roller 17 is formed by communicating a circular arc groove 27*a* formed at the central portion of the cam 25 and a circular arc groove 27*b* formed in the outer portion of the cam 25 to have substantially 160 angular degrees with each other by a straight communication groove 27*c*.

The cam groove 28 for contacting/releasing the thermal head 11 consists of a curved groove 28*a* formed from the central portion of the cam 25 to the outer periphery of the same and a circular groove 28*b* communicated to the outer end of the curved groove 28*a* to have an angular degree of substantially 190 degrees.

A head pressing lever 29 in the form of a bent shape is disposed adjacent to the cam 25. A side portion of the lower portion of the head pressing lever 29 is so supported that the head pressing lever 29 is able to swing relative to a shaft 30. The head pressing lever 29 has an end from which a pin 29*a* projects, the pin 29*a* being received in the head contacting/releasing cam groove 28 of the cam 25. Another end of the head pressing lever 29, through a pressing spring 31, presses the back surface of a head mounting frame 11*a*, on which the thermal head 11 is mounted.

A separation-roller drive lever 32 in the form of a substantially wedge shape is disposed adjacent to the cam 25. The separation-roller drive lever 32 has an end which has a pin 32*a* that is received by the cam groove 27 for contacting/releasing the separation roller 17, the cam groove 27 for contacting/releasing the separation roller 17 being formed in the surface of the cam 25. The separation-roller drive lever 32 has another end which has a second pin 32*b* capable of being received by a recess 33*a* of a transmission member 33 and a third pin 32*c* which can be inserted into a hole 33*b* formed in the transmission member 33 which synchronizes with the separation-roller drive lever 32. The separation-roller drive lever 32 has, on the top surface of substantially the central portion thereof, a cylindrical projection 32*d*.

A rod-like pin 33*c* is formed at an end of the transmission member 33, the pin 33*c* having a lower end which is secured to the carriage 3 through a spring 33*d*. The pin 33*c* is inserted into the hole 32*c* of the cylindrical portion 32*d* of the separation-roller drive lever 32 in such a manner that the top end of the pin 33*c* projects over the top end of the cylindrical portion 32*d*. Thus, the separation-roller drive lever 32 is held on the transmission member 33. A pin 34*a* disposed below a separation roller fastening member 34 is inserted into an elongated hole 33*d* formed at another end of the separation-roller drive lever 32. A pin (not shown) projecting over the carriage 3 is inserted into another end 34*b* of the separation roller fastening member 34 in such a manner that the separation roller fastening member 34 can be rotated around the pin. As a result, when the separation-roller drive lever 32 is rotated, the separation roller 17 contacts/separates with respect to the platen 1 through the transmission member 33. The employed ribbon cassette 60 presses the leading portion of the rod-like pin 33*c*. When the pin 33*c* is pressed downwards, the pin 32*c* of the separation-roller drive lever 32 is not inserted into the hole 33*b* of the transmission member 33. As a result, the separation roller 17 cannot be rotated.

The second winding bobbin 16 is rotatively inserted and received by a pin which is inserted into the hole 34*b* at the other end of the separation roller fastening member 34.

Figure 5:
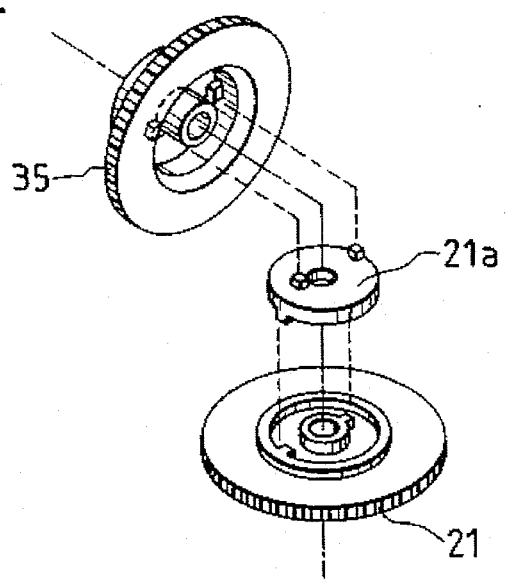
FIG. 5 is an exploded view showing the structure for establishing the connection between a second transmission gear and a gear of the thermal transfer printer according to the embodiment of the present invention.

The carriage 3 has the second transmission gear 21 which is always engaged to the output pinion gear 19 of the stepping motor 18 in such a manner that the second transmission gear 21 is able to rotate around the rotational shaft thereof. As shown in FIG. 5, a gear 35 which follows the rotation of the drive gear 21 is connected to the top surface of the second transmission gear 21 in such a manner that the gear 35 is connected through a connection member 21*a* to have a predetermined play. The gear 35 has, on the top surface thereof, a winding gear 36. The winding bobbin 14 is coaxially attached above the winding gear 36 through a friction mechanism.

The carriage 3 has a transmission gear 37 which is always engaged to the gear 35. A first swinging gear 38 and a second swinging gear 39, which are always engaged to the transmission gear 37, are connected to the transmission gear 37 by a swinging plate 37*a*. Note that the transmission gear 37 is always urged by a spring toward the winding gear 36.

The second winding bobbin 16 is disposed on the carriage 3 through the separation roller fastening member 34. A second winding gear 41 is coaxially attached below the second winding bobbin 16 through a friction mechanism (not shown), the second winding gear 41 being engaged to the winding gear 36 of the winding bobbin 14 through transmission gears 40*a* and 40*b*.

The first swinging gear 38 and the second swinging gear 39 are disposed in order to make constant the rotational direction of the winding bobbin 14 and the second winding bobbin 16 regardless of the direction of rotation of the stepping motor 18. In accordance with the rotational direction of the stepping motor 18, the first swinging gear 38 engages to the winding gear 36 or the second swinging gear 39 engages to the transmission gear 40*a*.

In this embodiment, when the stepping motor 18 rotates counterclockwise, the first swinging gear 38 engages to the winding gear 36. When the stepping motor 18 rotates clockwise, the second swinging gear 39 engages to the transmission gear 40*a* so that the rotational force is transmitted to the winding bobbin 36 and the second winding bobbin 41. Since the second transmission gear 21 and the gear 35 disposed on the top surface of the second transmission gear 21 are so disposed as to have a predetermined play by the connection member 21*a*, rotation of the second transmission gear 21 is not transmitted to the gear 35 if the rotational direction of the stepping motor 18 is inverted, for example, if the cam 25 is rotated for perform the head up operation or the head down operation. In the foregoing case, the operation for winding the ribbon is not performed. A spring clutch is disposed between the winding bobbin 14 and the winding gear 36 so that the winding bobbin 14 is always rotated in a predetermined direction (in a direction in which the ink ribbon 70 is wound). As a result, the ink ribbon 70 wound around the winding bobbin 14 is inhibited from being drawn out in the inverse direction, thereby preventing looseness of the ink ribbon 70 or the like.

The supply bobbin 13 is disposed on the top surface of the cam 25. A supply gear 42 is coaxially attached below the supply bobbin 13 through a friction mechanism (not shown) so that a predetermined supply load (back tension) is applied to the ink ribbon 70 or so that an operation of rewinding the ink ribbon 70 is enabled when the ribbon cassette 60 is changed in a manner to be described later.

The transmission mechanism 43 is disposed adjacent to the cam 25. The transmission mechanism 43 includes a gear 44*a*, which can be engaged to the second intermittent gear 25*d* formed in the lower portion of the outer surface of the cam 25, a gear 44*b* which can be engaged to the first intermittent gear 25*c*, a transmission gear 44*d* integrally rotates with the gear 44*a*, and another transmission gear 44*c* connected to the gear 44*b* through the spring clutch mechanism and arranged to transmit only counterclockwise rotation of the gear 44*b*. The gear 44*a* engages to the second intermittent gear 25*d* and rotates when the cam 25 at the first head up position is rotated to, through the gear 44*d*, transmit the rotational force to a lift gear 46 to be described later.

The gear 44*b* or the gear 44*a*, which can be engaged to the first intermittent gear 25*b* or the second intermittent gear 25*c* of the cam 25 provided for the transmission mechanism 43 has a shape such that two large teeth and one small tooth are alternately formed. Thus, the transmission between the first intermittent gear 25*b* and the first intermittent gear 25*c* is performed reliably.

Figure 6:
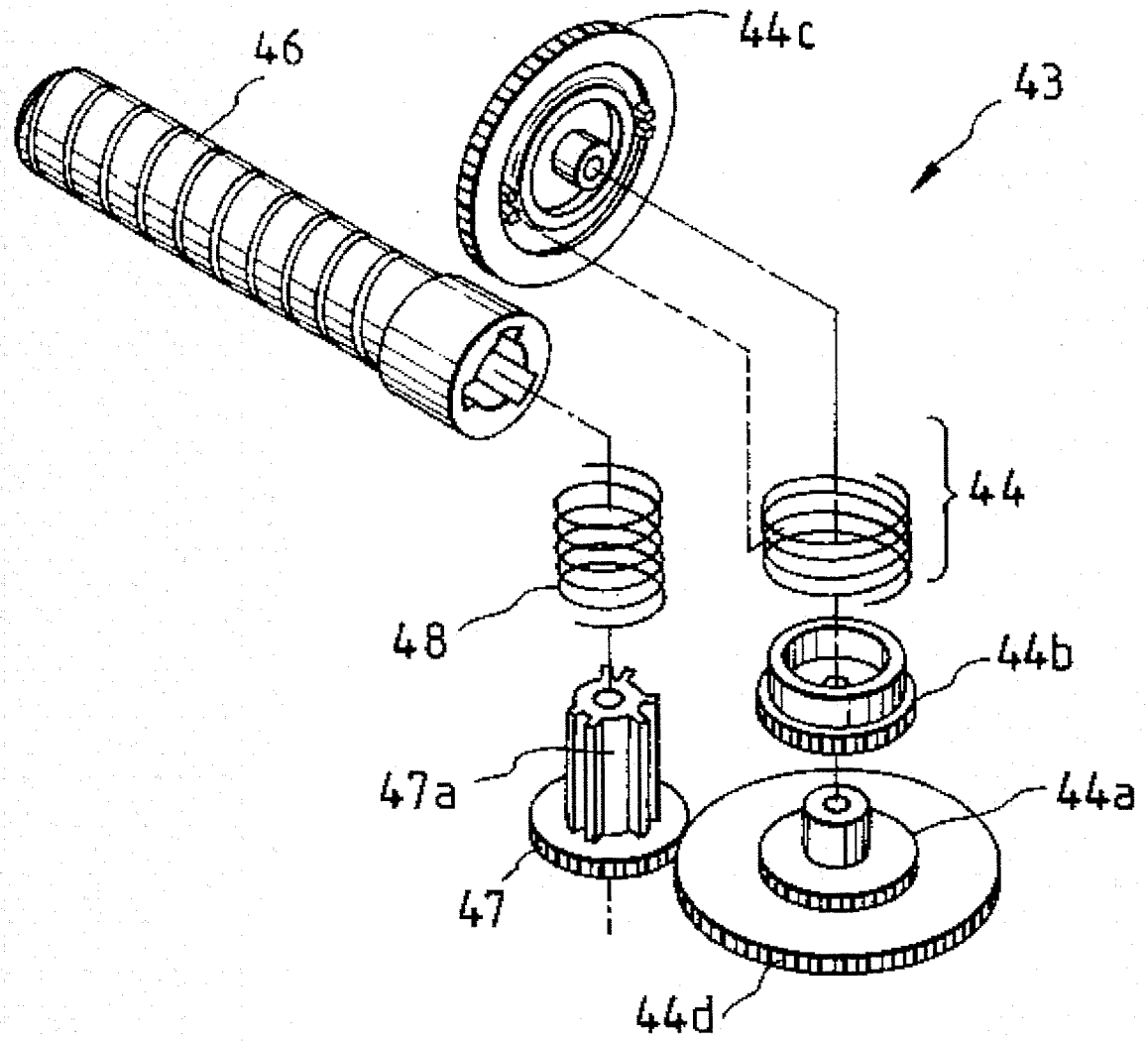
FIG. 6 is an exploded view showing the structures of a lift gear and a transmission member of a drive mechanism of a cassette carrier of the thermal transfer printer according to the embodiment of the present invention.

Since the upper gear 44*b* and the transmission gear 44*c* disposed on the top surface of the gear 44*b* are disposed through the spring clutch 44*d* (see FIG. 6), the upper gear 44*b* and the transmission gear 44*c* are always rotated in one direction (counterclockwise in this embodiment). Therefore, the supply gear 42 engaged to the transmission gear 44*c* is able to rotate in only the rewinding direction. As a result, a predetermined load of the friction mechanism acts on the ink ribbon 70 which is being supplied. Thus, looseness and the like taking place when the ink ribbon 70 is drawn out is prevented.

The lift gear 46 is disposed adjacent to the transmission mechanism 43, the lift gear 46 having a screw groove 46*a* on the outer surface thereof. The lower end of the lift gear 46 is, through a spring 48, spline-connected to a rotational shaft 47*a* of a gear 47 which engages to the gear 44 engaged to the intermittent gear 25*b* provided for the cam 25. As a result, the lift gear 46 is rotated together with the gear 47 in such a manner that the lift gear 46 is able to move vertically by a somewhat degree thanks to the effect of the coil spring 48.

As shown in FIG. 1, the cassette carrier 12 has a hole 12*a* having a tooth portion, which engages to a screw groove 46*a* of the lift gear 46, and guide holes 12*b* and 12*c* into which a pair of guide members 49*a* and 49*b* disposed on the carriage 3 are respectively inserted. Thus, when the lift gear 46 is rotated, the cassette carrier 12 is able to, along the guide members 49*a* and 49*b*, reciprocate on the carriage 3 in a direction perpendicular to the moving direction of the carriage 3. The cassette carrier 12 has a pair of wedge-shape holding members 12*d* and 12*e* which are fastened to a portion for holding the ribbon cassette 60 and which hold the ribbon cassette 60, the holding members 12*d* and 12*e* being disposed apart from each other in the lateral direction. The holding members 12*d* and 12*e* are urged in a direction in which their interval is reduced by an urging member (not shown).

As shown in FIG. 1, the carriage 3 has, thereon, a sensor plate 50 having a first sensor 51 for detecting the type of the ribbon cassette 60 held by a cassette holding portion (not shown) at a predetermined position of the case of the thermal transfer printer and a second sensor 52 for detecting whether the ribbon cassette 60 exists on the carriage 3. As shown in FIG. 1, the first sensor 51 and the second sensor 52 are reflection-type optical sensors having different focal lengths. The shape of the sensor plate 50 is arranged such that the first sensor 51 is disposed somewhat apart from the ribbon cassette 60 and the second sensor 52 is disposed adjacent to the ribbon cassette 60.

A control means 54 having a storage means 53 is disposed at a position (not shown) of the thermal transfer printer. The control means 54 totally controls the operations of the thermal transfer printer. In this embodiment, the storage means 53 and control means 54 perform the following special operations.

The storage means 53 stores the position of the cassette carrier 12 and the type of the ribbon cassette 60 (the color of the accommodated ink ribbon 70) mounted on the cassette carrier 12, which have been detected by the first sensor 51 and second sensor 52. When the control means 54 receives an end-detection signal of the ink ribbon 70 of the ribbon cassette 60 detected by a ribbon-end detection means (not shown), the control means 54 causes the ribbon cassette 60 to be accommodated in an empty cassette holding portion in accordance with the contents stored by the storage means 53 and selects an unused ribbon cassette 60 to mount the ribbon cassette 60 on the carriage 3.

The operation of this embodiment having the foregoing structure will now be described.

The printing operation is performed as follows.

Initially, the carriage 3 is reciprocated along the platen 1, the first sensor 50 detects the type and position of the ribbon cassette 60 mounted on the cassette carrier 12 to store the type and position in a memory. As a result, the type of the ribbon cassette 60 and the cassette carrier 12, on which the ribbon cassette 60 is mounted, are stored.

Then, the printing operation starts. When the stepping motor 18 is rotated clockwise, the first transmission gear 20 is rotated counterclockwise. As a result, the swinging plate 22 is rotated counterclockwise so that the first swinging gear 23 engages to the gear 25*a* on the outer surface of the cam 25. When the stepping motor 18 is further rotated in the foregoing state, the cam 25 is rotated counterclockwise so that the pin 29*a* of the head pressing lever 29 is located at an innermost position of the head contacting/releasing cam groove 28. Since the head pressing lever 29 is swung to the leftmost position at this time, the head mounting frame 11*a* is, together with the head pressing lever 29, operated, thereby realizing a state where the thermal head presses against the platen, that is a so-called head down state. In the foregoing state, the first swinging gear 23 is located at the tooth-less portion 25*b* of the gear 25*a* at the outer surface of the cam 25. Even if the stepping motor 18 is further rotated counterclockwise, the rotational force of the first swinging gear 23 is not transmitted to the cam 25, thereby stopping the cam 25 at the foregoing position. Since the pin 32*a* of the separation-roller drive lever 32 is located at the innermost position of the separating cam groove 27 on the surface of the cam 25, the separation-roller drive lever 32 is swung to the rightmost position relative to the pin 33*c*. As a result, the transmission member 33 is rotated to the right through the pin 32*c* and, therefore, the separation roller fastening member 34 is brought into a state where it has rotated in a direction toward the platen 1. Although the rotational force of the stepping motor 18 is transmitted to the second transmission gear 21 in the state where the cam 25 is rotating, the play existing between the second transmission gear 21 and the gear 35 inhibits rotation of the gear 35. Although the rotational force of the cam 25 during the head down operation is, as the counterclockwise rotational force, transmitted to the gear 44*b* through the first intermittent gear 25*c*, the foregoing connection established between the gear 44*b* and the gear 44*c* through the spring clutch inhibits rotation of the gear 44*c*. Therefore, also the supply gear 42 is not rotated, thereby preventing undesirable feeding and looseness of the ink ribbon.

When the stepping motor 18 is further rotated clockwise in the foregoing state, the play existing between the transmission gear 21 and the gear 35 is suspended. As a result, the rotation of the second transmission gear 21 is transmitted to the gear 35, thereby rotating the gear 35 together with the second transmission gear 21. The rotation of the second transmission gear 21 is transmitted to the transmission gear 37 so that the transmission gear 37 is rotated clockwise. The clockwise rotation of the transmission gear 37 causes the second swinging gear 39 engaged to the transmission gear 37 to swing so as to be engaged to the transmission gear 40*a*. Thus, the rotation of the transmission gear 40*a* is transmitted to the winding gear 36 and the same is transmitted to the second winding gear 41 through the transmission gear 40*b*, thereby rotating the winding bobbin 14 and the second winding bobbin 16. As a result, the operation for winding the ink ribbon is performed.

Therefore, rotation of the carriage drive motor 4 in the foregoing head down state to selectively operate the thermal head 11 while moving the carriage 3 and rotation of the stepping motor 18 to wind the ink ribbon enable the recording operation to be performed.

The foregoing head down state is shifted to the head up state as follows: when the stepping motor 18 is rotated counterclockwise in the head down state, the first transmission gear 20 is rotated clockwise. As a result, the swinging plate 22 is swung to the right so that the first swinging gear 23 is separated from the outer surface of the cam 25 and the second swinging gear 24 is engaged to the gear portion 25*a* on the outer surface of the cam 25. When the stepping motor 18 is, in the foregoing state, rotated in the foregoing direction, clockwise rotation of the cam 25 is continued. As a result, the pin 29*a* of the head pressing lever 29 is located at the outermost position of the head contacting/releasing cam groove 28. Since the head pressing lever 29 is swung to the rightmost position at this time, the head mounting frame 11*a* is, together with the head pressing lever 29, moved. Therefore, the thermal head 11 is located at the farthermost position from the platen 1, that is, the same is held in a so-called head up state. When the stepping motor 18 is rotated clockwise in the foregoing state, the first swinging gear 23 is separated from the outer surface of the cam 25 and the second swinging gear 24 is engaged to the gear 25*a* of the cam 25. Thus, the cam 25 is rotated. When the stepping motor 18 is again rotated counterclockwise in the foregoing state, the pin 22*a* of the swinging plate 22 is located in the communication groove 26*c* of the first cam groove 26, thereby separating the second swinging gear 24 from the gear 25*a* on the outer surface of the cam 25. Since also the first swinging gear 23 is separated from the outer surface of the cam 25 at the foregoing position, further counterclockwise rotation of the stepping motor 18 does not cause the rotational force of the stepping motor 18 to be transmitted to the cam 25. Thus, the state where the cam 25 is held in a stationary manner is maintained. Since the pin 32*a* of the separation-roller drive lever 32 is located at the outermost position of the separation roller contacting/releasing cam groove 27 in the surface of the cam 25, the separation-roller drive lever 32 is swung to the leftmost position relative to the pin 33*c*. As a result, the transmission member 33 is rotated to the left through the pin 32*c*, thereby realizing a state where the separation roller fastening member 34 is located apart from the platen 1. Although the rotational force of the stepping motor 18 is transmitted to the second transmission gear 21 in the foregoing state where the cam 25 is being rotated, the play existing between the second transmission gear 21 and the gear 35 inhibits the rotation of the gear 35. During the head up operation, the rotational force of the cam 25 is transmitted to the gear 44*b* through the first intermittent gear 25*c* as counterclockwise rotational force. Therefore, the gear 44*c* is, together with the gear 44*b*, rotated counterclockwise as described above so that the supply gear 42 is rotated clockwise, thereby performing the operation for winding the ink ribbon.

If the carriage 3 is operated in the foregoing head up state, the recording operation is not performed. In a case where a color image recording operation is performed by using an ink ribbon 70 formed by repeating a plurality of color ink portions in the lengthwise direction thereof, the ink ribbon 70 must be idly fed to cause an ink portion in a desired color to face the thermal head 11. Therefore, the stepping motor 18 is rotated counterclockwise. As a result, when the stepping motor 18 has rotated by a predetermined amount, the play existing between the drive gear 21 and the gear 35 is suspended. Further rotation of the stepping motor 18 causes the rotation of the drive gear 21 to be transmitted to the gear 35. Thus, the gear 35 is rotated together with the second transmission gear 21. The rotation of the gear 35 is transmitted to the transmission gear 37, thereby rotating the transmission gear 37 counterclockwise. The counterclockwise rotation of the transmission gear 37 causes the first swinging gear 38 engaged to the transmission gear 37 to be swung and engaged to the winding gear 36. The rotation of the winding gear 36 rotates the winding bobbin 14, and the rotation of the winding gear 36 is transmitted to the second winding gear 41 through the transmission gears 40*a* and 40*b*. As a result, the second winding bobbin 16 is rotated so that the operation for winding the ink ribbon 70 is performed.

If the stepping motor 18 is, in the foregoing state, rotated clockwise, the swinging plate 22 is rotated to the left so that the pin 22*a* is shifted from the specific position 26*c* into the first cam groove 26. Further clockwise rotation of the stepping motor 18 results in the head down operation being performed.

The method of changing the ribbon cassette 60 to be mounted on the cassette carrier 12 will now be described.

Initially, the operation for mounting a desired ribbon cassette 60 in a state where no ribbon cassette 60 is mounted on the cassette carrier 12 will now be described.

In the head up state, the head down state is realized, and in the head down state the stepping motor 18 is rotated counterclockwise in the head down state. Thus, the clockwise rotation of the transmission gear 20 causes the second swinging gear 24 to be engaged to the gear 25*a* of the cam 25, thereby clockwise rotating the cam 25. As a result, the thermal head 11 is brought to the head up state as described above. When the stepping motor 18 is further rotated in the foregoing state, the pin 29*a* of the head pressing lever 29 is, in the head up state, moved along the circular arc groove 29*a* in the outer surface of the cam groove 28.

At this time, the intermittent gear 25*c* formed below the outer surface of the cam 25 is engaged to the gears 44*a* and 44*b* of the transmission member 43 so that the gears 44*a* and 44*b* are rotated. Thus, the gear 44*d* is so rotated that the gear 47 is rotated. The rotation of the gear 47 rotates the lift gear 46. The rotation of the lift gear 46 upwards moves the cassette carrier 12 along the guide members 49*a* and 49*b*. As a result, the holding claws 12*d* and 12*e* of the cassette carrier 12 are fastened to holding portions 66*a* and 66*b* formed on the outer surface of the ribbon cassette 60, thereby holding the ribbon cassette 60.

Even if the position, at which the ribbon cassette 60 is held, somewhat disperses, the spline-connection of the lift gear 46 to the shaft 47*a* of the gear 47 through the coil spring 48 (see FIG. 6) is able to absorb vertical rattling. Although the gear 44*b* is rotated, the connection between the gear 44*b* and the transmission gear 44*c* through the spring clutch inhibits the rotation of the transmission gear 44*c*.

After the ribbon cassette 60 has been held, the stepping motor 18 is rotated clockwise. As a result, the cam 25 is rotated counterclockwise through the first swinging gear 23. At this time, the gears 44*a*, 44*d* and 47 are rotated through the intermittent gear 25*c*, causing the lift gear 46 to be rotated. Thus, the cassette carrier 12 is moved downwards so as to be located on the carriage 3. As a result, a desired ribbon cassette 60 is mounted on the carriage 3.

Figure 7:
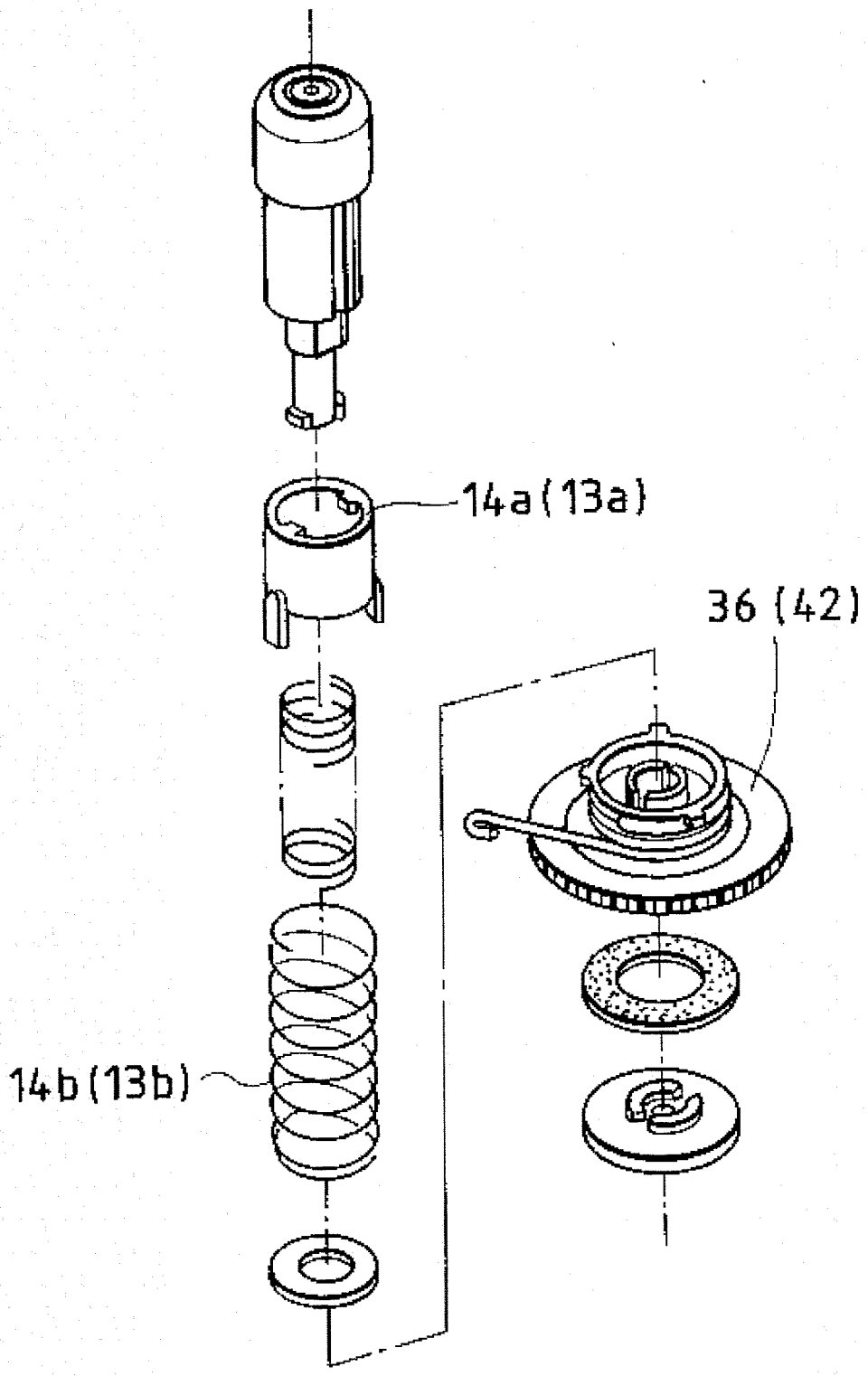
FIG. 7 is an exploded diagram showing the structures of a ribbon winding bobbin and a supply bobbin of the thermal transfer printer according to the embodiment of the present invention.
Figure 8:
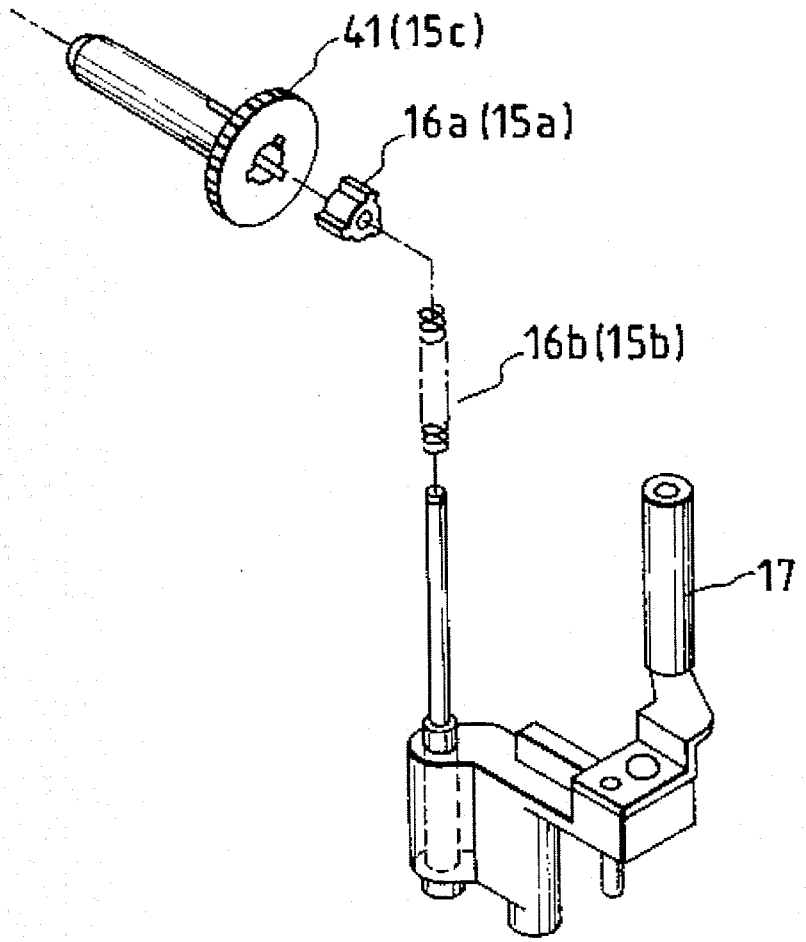
FIG. 8 is an exploded diagram showing the structures of a second ribbon winding bobbin and a feeding bobbin of the thermal transfer printer according to the embodiment of the present invention.
Figure 9:
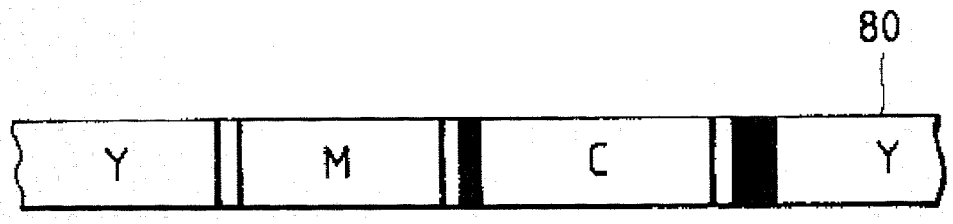
FIG. 9 PRIOR ART
FIG. 9 is a diagram showing the structure of a general triple color ink ribbon.

As shown in FIGS. 7 and 8, fastening members 14*a* and 16*a* (13*a* and 15*a*) to be fastened to the reels 61 and 62 of the ribbon cassette 60 and formed on the first winding bobbin 14, second winding bobbin 16 and the supply bobbins 13 and 15 can be vertically moved through springs 14*b* and 16*b* (13*b* and 15*b*). Therefore, even if the engagement has not been performed satisfactorily at the time of changing the ribbon cassette 60, the fastening members 14*a* and 16*a* (13*a* and 15*a*) are pressed downwards against the urging force of the spring, and then they are pushed upwards due to the urging force of the spring at a moment the positions align to each other due to the rotation of the bobbins 13 and 14. As a result, fastening can be performed reliably.

Then, a case where the ribbon cassette 60 has been mounted on the cassette carrier 12 and the mounted ribbon cassette 60 is changed to another ribbon cassette 60 will now be described.

Initially, the carriage 3 is reciprocated, and a holding portion of the case of the thermal transfer printer, which has not the ribbon cassette 60, is detected by the first sensor 51. If the position has been detected, the control means 54 brings the carriage 3 to a position corresponding to the detected position. Then, the cassette carrier 12 is moved upwards so that the ribbon cassette 60 is held by the holding portion. Subsequently, the cassette carrier 12 is moved downwards, and a desired ribbon cassette 60 is mounted similarly to the foregoing case where the ribbon cassette 60 is not mounted.

A case will now be described in which a plurality of same color ribbon cassettes 60 are mounted and a same-color recording operation is performed by changing the ribbon cassette 60 if the ink ribbon has been consumed.

Initially, a ribbon cassette 60 is selected from the cassette carrier 12 located near a position, at which the printing operation starts, to mount the selected ribbon cassette 60 on the carriage 3. Furthermore, the position of the cassette carrier 12 is stored in the storage means 53. If the end of the ink ribbon 70 of the ribbon cassette 60 is detected, the control means 54 returns the used ribbon cassette 60 to the cassette holding position of the body of the thermal transfer printer in accordance with information stored in the storage means 53. Then, a ribbon cassette 60 for the same color in another cassette holding portion nearest the foregoing cassette holding portion is selected, and the selected ribbon cassette 60 is mounted on the carriage 3. At this time, the position of the cassette-holding portion accommodating the new ribbon cassette 60 is stored in the storage means 53. Thus, whenever the end of the ink ribbon 70 is detected, change to a new ribbon cassette 60 is performed. If the ribbon cassettes 60 have been consumed by a number stored previously, a signal for causing a new ribbon cassette 60 to be mounted on the cassette carrier 12 is transmitted to indicate the consumption of the ribbon cassettes 60 with respect to a user.

If the power supply is interrupted before all ribbon cassettes 60 are consumed, the previous state is stored in a nonvolatile memory disposed in the storage means 53. Thus, selection and change of the ribbon cassette 60 can be performed smoothly.

Note that the present invention is not limited to the foregoing embodiment but a certain degree of change is permitted as the need arises. Although this embodiment has a structure that the cassette mounting frame is, by the drive means, moved in a direction in which it contacts and separates with respect to the ribbon cassette holding portion, another structure may be employed in which the ribbon cassette holding portion is moved in a direction in which the same contacts and separates with respect to the cassette mounting frame.

As described above, in the present invention, ribbon cassettes accommodating same-color ink ribbons are mounted on a plurality of cassette carriers, and whenever one ribbon cassette is consumed, change to a new ribbon cassette is performed to continue the printing operation. Thus, the period, in which the ribbon cassette can be used, can be elongated and, therefore, cassette change can easily and simple be performed. Thus, a thermal transfer printer which can easily be used can be provided.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A thermal transfer printer comprising:

a carriage capable of reciprocating along a platen;

a cassette mounting frame which is disposed on said carriage and on which a ribbon cassette can be mounted;

a plurality of cassette holding portions formed at positions at which said plurality of cassette holding portions face said cassette mounting frame and each of which is capable of holding the ribbon cassette;

cassette detection means disposed on said carriage and capable of detecting the type of the ribbon cassette held in said cassette holding portion when said carriage is moved;

ribbon-end detection means disposed on said carriage and capable of detecting the end of the ink ribbon accommodated in the ribbon cassette mounted on said carriage; and drive means for reciprocating said cassette mounting frame and said cassette holding portion in directions in which said cassette mounting frame and said cassette holding portion mutually contact and separate from each other, wherein said drive means causes said cassette mounting frame and said cassette holding portion to contact and separate from each other to enable the ribbon cassette to be supplied/received between said cassette mounting frame and said cassette holding portion, and said thermal transfer printer further comprises control means arranged such that, when said ribbon-end detection means has detected the end of the ink ribbon in the ribbon cassette mounted on said carriage in a case where ribbon cassettes accommodating the same color ink ribbons are held in at least two cassette holding portions, said control means causes the consumed ribbon cassette to be sent to an empty cassette holding portion, said cassette detection means to detect a ribbon cassette accommodating another same color ink ribbon, and the detected ribbon cassette to be received from said cassette holding portion and to be mounted on said cassette mounting frame.

2. A thermal transfer printer comprising:

a carriage capable of reciprocating along a platen;

a cassette mounting frame which is disposed on said carriage and on which a ribbon cassette can be mounted;

a plurality of cassette holding portions formed at positions at which said plurality of cassette holding portions face said cassette mounting frame and each of which is capable of holding the ribbon cassette;

cassette detection means disposed on said carriage and capable of detecting the type of the ribbon cassette held in said cassette holding portion when said carriage is moved;

ribbon-end detection means disposed on said carriage and capable of detecting the end of the ink ribbon accommodated in the ribbon cassette mounted on said carriage; and drive means for reciprocating said cassette mounting frame and said cassette holding portion in directions in which said cassette mounting frame and said cassette holding portion mutually contact and separate from each other, wherein said drive means causes said cassette mounting frame and said cassette holding portion to contact and separate from each other to enable the ribbon cassette to be supplied/received between said cassette mounting frame and said cassette holding portion, and said thermal transfer printer further comprises storage means, arranged such that, in a case where ribbon cassettes accommodating the same color ink ribbons are held in at least two cassette holding portions, said storage means stores the positions of the cassette holding portions and the type of the ribbon cassettes;

means arranged such that, when said ribbon-end detection means has detected the end of the ink ribbon in the ribbon cassette mounted on said carriage, said means detects whether or not a ribbon cassette of the same type as the consumed ribbon cassette is held in said cassette holding portion, and control means arranged such that, if the same type ribbon cassette is held, said control means causes the consumed ribbon cassette to be sent to an empty cassette holding portion, said cassette detection means to detect a ribbon cassette accommodating another same color ink ribbon, and the detected ribbon cassette to be received from said cassette holding portion and to be mounted on said cassette mounting frame.

* * * * *